United States Patent [19]

Guillory

[11] 4,105,865

[45] Aug. 8, 1978

[54] AUDIO DISTRIBUTOR

[76] Inventor: Henry Guillory, 186 Day St., San Francisco, Calif. 94131

[21] Appl. No.: 799,071

[22] Filed: May 20, 1977

[51] Int. Cl.[2] ..... H04R 5/00

[52] U.S. Cl. ..... 179/1 G; 179/1 GQ; 200/23

[58] Field of Search ..... 179/1 G, 1 GP, 1 GQ, 179/1 SW; 200/28, 23

[56] References Cited

U.S. PATENT DOCUMENTS

| | | | |
|---|---|---|---|
| 1,731,513 | 10/1929 | Wagner | 200/23 |
| 3,374,315 | 3/1968 | Gladwin | 179/1 G |
| 3,757,046 | 9/1973 | Williams | 179/1 G |
| 3,982,071 | 9/1976 | Weiss et al. | 179/1 GP |
| 4,002,836 | 1/1977 | Gardner | 179/1 VL |

FOREIGN PATENT DOCUMENTS

| | | | |
|---|---|---|---|
| 2,341,342 | 2/1975 | Fed. Rep. of Germany | 179/1 GP |

*Primary Examiner*—Douglas W. Olms
*Attorney, Agent, or Firm*—Townsend and Townsend

[57] ABSTRACT

An audio distributor interconnects a source of at least one electrical audio signal and a plurality of sound-producing speakers to sequentially apply the signal to each speaker in serial fashion. The distributor includes a support member having mounted on an outer surface thereof a number of interconnected conductive segments, each segment corresponding to one of the speakers. A motor rotates the support member, moving each conductive segment into contact with an electrical pickup to establish electrical communication between the segment associated with each speaker and the audio signal source. The conductive segments and their associated electrical pickups are arranged so that rotation of the support member sequentially places the conductive segments in position to cause the audio signal to be applied to at least one speaker at a time in serial fashion. With the speakers arranged to define the perimeter of a listening area mutually exclusive, serial application of the audio signal to the speakers simulates movement and spatial distribution of the sound about the listening area.

7 Claims, 5 Drawing Figures

AUDIO DISTRIBUTOR

This invention relates to apparatus that selectively and sequentially distributes an electricial audio signal to a plurality of speakers in serial fashion to simulate spatial distribution of the sound produced by the speakers.

BACKGROUND OF THE INVENTION

The concept of arranging a number of sound-producing speakers about a listening area and then selectively distributing an electrical audio signal (monoaural, stereo or quadraphonic) to the speakers is conventional. The concept aims at providing a listener with the sensation of movement of sound about him or her. For example, one such distribution system employs a series of individual coils arranged to have an annular ring rotated therethrough. Each coil is serially interconnected with a corresponding speaker and amplifier. The ring is fabricated of a dielectric material except for a short arcuate section of iron. The ring is rotated, moving the iron slug through the coil and in so doing attenuates the speaker associated with each coil through which the iron slug passes.

Other known sound distribution devices utilize electronic switching or elaborate electronic amplifying techniques to achieve the same results. Representative examples of such sound distribution equipment can be found in U.S. Pat. Nos. 2,832,829, 3,873,779, and 4,002,836.

Unfortunately, systems like those described above and disclosed in the patents are not without certain problems. For example, placing a varying inductance in the signal path connecting the signal source to the speaker tends to introduce distortion into the signal. Further, switching noise can also be imposed when switching the signal from one speaker to another. Some sound distribution techniques require the use of extra power or isolation amplifiers for each speaker for proper impedance matching and operation.

SUMMARY OF THE INVENTION

An audio distributor interconnects a source of at least one electrical audio signal and a plurality of speakers that are arranged about the perimeter of a listening area to sequentially apply the signal to each speaker in serial fashion, phasing the signal from one speaker to its adjacent speaker. The distributor includes a support member with a number of interconnected conductive segments affixed to its outer surface, each segment corresponding to one of the speakers. A motor rotates the support member to move each conductive segment into electrical communication with a pair of spaced finger contacts to establish an electrical path for the signal between the signal source and the speakers. The conductive segments and the finger contacts are arranged so that the audio signal is sequentially applied to at least one speaker at a time in serial fashion as the support member is rotated. Preferably, the audio distributor of the present invention applies the audio signal (or signals in the case of stereo) simultaneously to adjacent speaker pairs, sequentially moving the signal from one adjacent speaker pair to the next adjacent speaker pair.

In one embodiment the support member comprises a cylindrical drum whose outer surface supports a plurality of circumferentially extending, electrically interconnected, conductive segments. An input segment corresponding to the output of the source, encircles the drum forming a circumferential track thereabout. The remaining conductive segments, each corresponding to one of the plurality of speakers, are arranged in circumferentially staggered, longitudinally adjacent fashion on the drum surface. A number of conductive finger contacts are mounted adjacent to and in tangential engagement with the drum, there being one finger contact for the input segment and one for each of the remaining segments. The finger contact that engages the input segment is electrically coupled to the signal source while the remaining finger contacts are coupled to the speakers.

When the drum is rotated about its longitudinal axis, the staggered conductive segments are sequentially moved into and out of engagement with their respective finger contacts. In turn, an electrical path is thereby established between the signal source and each segment's corresponding speaker so that the signal is serially applied to each speaker and removed therefrom to be applied to its adjacent speaker.

In a further embodiment of the present invention a metal disk with a short radially extending appendage is mounted on a shaft that rotates the disk. An input finger contact is mounted adjacent to and in continuous slidable contact with the disk. A number of output contact fingers are mounted proximate the disk so that only the appendage of the disk serially engages the output fingers when the disk is rotated, each output finger corresponding to one of the speakers. The signal source is electrically wired to the input finger and each output finger is wired to its corresponding speaker. Rotation of the disk sequentially establishes electrical communication between the input finger and one of the output fingers to apply the audio signal to the speakers in serial fashion.

A number of advantages are achieved by the audio signal distributor of the present invention.

First, the present invention minimizes noise or distortion sometimes introduced into the audio signal by certain of the prior art systems. In turn, the expense of designing and adding apparatus to attempt to obviate these undesirable features is also reduced. The present invention induces no perceptible switching noise into the signal for pickup by the speakers.

Second, when the audio signal is applied to adjacent speaker pairs, in a sequential and serial fashion about the listening area, it has been found that a sensation of additional "presence" or depth to the sound is created. It is believed that the deterioration in a listener's ability to detect the sound source simulates a spatial dimension to the sound and gives the sense of improving the accoustical quality thereof through the use of multiple speakers.

Finally, the present invention is achieved through apparatus that is of simple construction, requires a minimum number of parts, is inexpensive to manufacture (and maintain) and simple to use. In particular, the present invention can easily be inserted into existing sound systems without requiring the use of additional amplifiers or impedance matching devices.

For a fuller understanding of the nature and advantage of the invention, reference should be had to the ensuing detailed description taken in conjunction with the accompanying drawings.

DETAILED DESCRIPTION OF THE PREFERRED EMBODIMENTS

Figure 1:
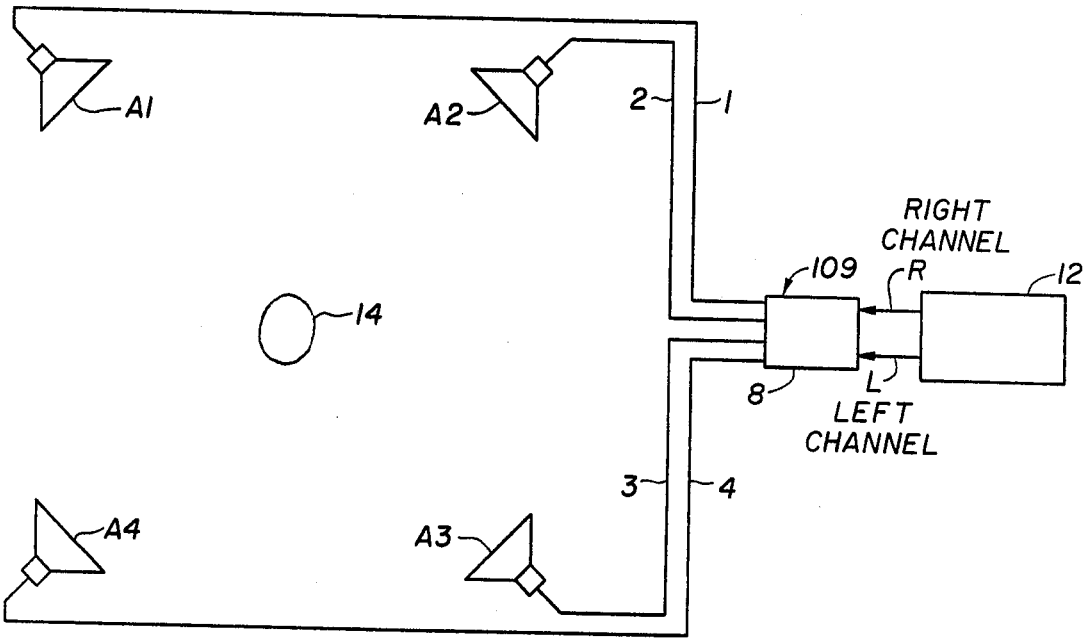
FIG. 1 is a schematic block diagram illustrating arrangement of a system utilizing the audio signal distributor of the present invention.

Turning now to the drawings, FIG. 1 illustrates use of the audio signal distributor of the present invention, generally designated by the reference numeral 10, to distribute a pair of audio signals from a source such as a stereo receiver 12 to four speakers A1-A4. Interconnecting the output section (not shown) of the left and right channels of the stereo receiver 12 and distributor 10 are the left and right audio cables L and R. Although not specifically illustrated, it is common knowledge in this art that such audio cables as L and R are twin lead cables; one lead of each cable is the signal carrying lead while the other lead is the amplifier ground or return. Similarly, electrical wires 1–4 interconnecting distributor 10 and speakers A1–A4 are also of a twin lead variety. The common or ground lead of each wire 1–4 is interconnected with the ground leads of L and R to establish a common ground between the speakers, the distributor, and the receiver 12.

It should be understood that although FIG. 1 illustrates the use of distributor 10 with a receiver 12 having two (stereo) outputs, the present invention is also ideally adaptable for use with monoaural apparatus. In the case of monoaural devices, however, the single output would split into two identical audio electrical signals using an appropriate Y-connector. These two signals would then be applied to inputs 8 and 9 of distributor 10.

Figure 2:
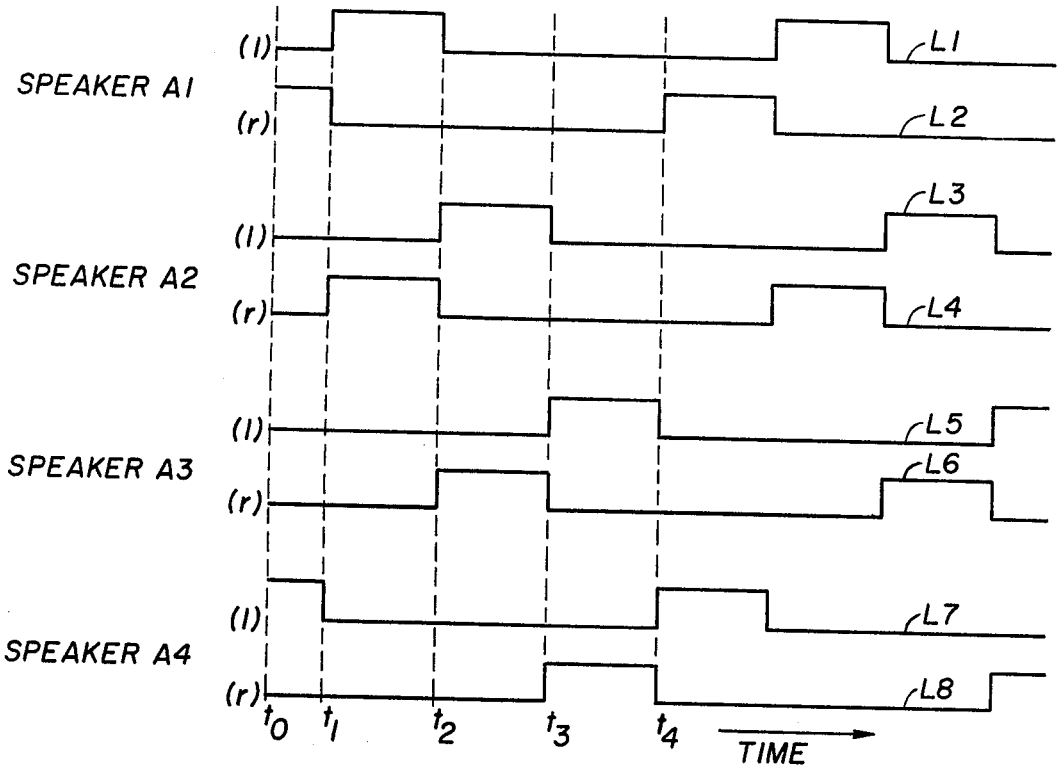
FIG. 2 is a graphic illustration of the manner in which the audio signal distributor applies the signal to the speakers shown in FIG. 1.

Preferably, distributor 10 operates to sequentially apply the audio signals received to selected adjacent pairs of speakers A1-A4 in serial fashion; that is, the audio signal (1) communicated to input 8 of distributor 10 is applied to one for the speakers A1-A4, removed therefrom and applied to an adjacent speaker so that audio signal (1) is applied to each speaker, one at a time, in serial fashion. In similar manner, the audio signal *(r)* received at input 9 of the distributor is applied to the speaker from which audio signal (1) has just been removed. Thus, audio signal (1) and *(r)* are sequentially applied to a adjacent speaker pairs. FIG. 2 illustrates graphically the manner in which the left (1) and right *(r)* audio signals are distributed and applied to speakers A1-A4. Each horizontal line L1-L8 represents the presence or absence of one of the audio signals (1) or *(r)* at speakers A1-A4. For example, at time $t_0$ the audio signal (1) is present only at speaker A4 while the audio signal *(r)* is present at (adjacent) speaker A1.

At time $t_1$, distributor 10 redistributes the audio signals so that audio signal (1) has been removed from speaker A4 and applied to speaker A1. Simultaneously, audio signal *(r)* has been removed from speaker A1 and applied to speaker A2. Similar signal redistributions occur at times $t_2$, $t_3$ and $t_4$ to sequentially apply the audio signals to adjacent speaker pairs.

So distributed, the sound reproduced by speakers A1-A4 from the audio signals (1) and *(r)* revolve about the listening area defined by the arranged speakers A1-A4. Thus, a listener 14 positioned within the listening area defined by the arrangement of speakers A1-A4 would perceive the sound as revolving about him or her. As the sound does revolve, the inability of listener 14 to accurately pinpoint the sound source is impaired which, in turn, simulates the addition of a spatial dimension. In effect the sensation of, if not actual, improved accoustic quality of the sound is achieved. This sensation is provided for both monaural and stereo sound.

Figure 3:
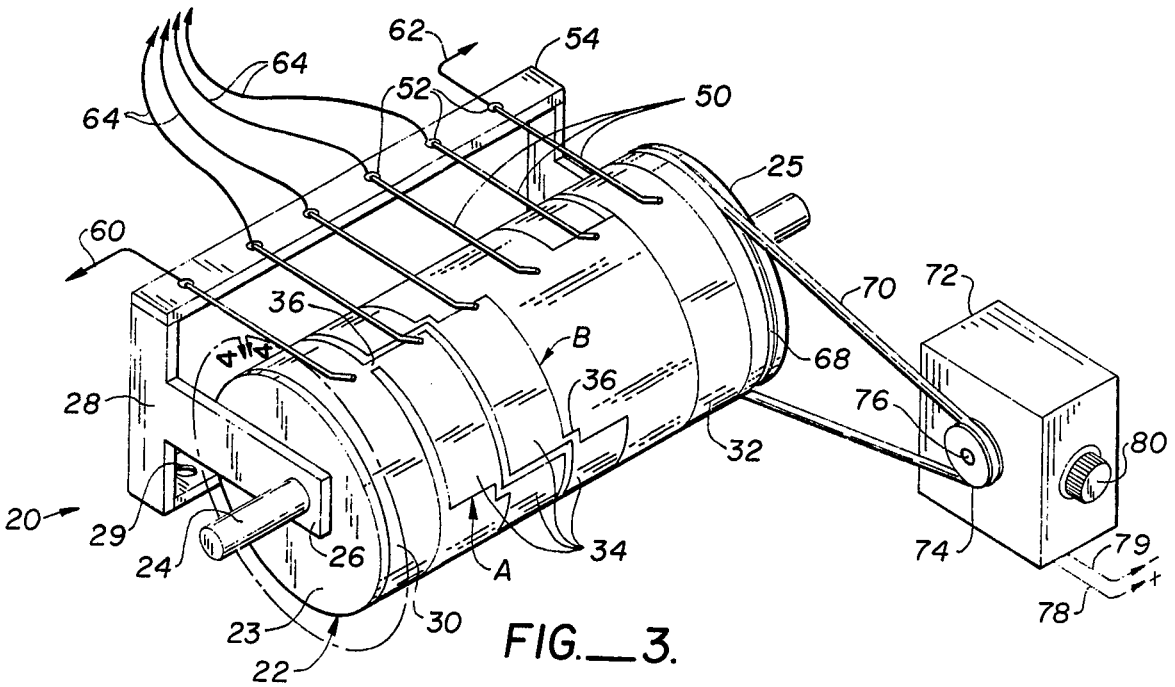
FIG. 3 is a perspective view illustrating the embodiment of the present invention utilizing a cylindrical drum with conductive segments mounted on the outer surface thereof.

Having set forth the objects sought to be achieved by the audio distributor of the present invention and the operative manner by which these objects are obtained, the construction and operation of the embodiments of the present invention will now be discussed. Referring now to FIG. 3, there is illustrated one arrangement for distributing the audio signals (1) and *(r)* received by the sound distributor 10 at inputs 8 and 9. The distributor 10 would, therefore, include a phasing unit 20 comprising a drum 22 mounted for rotation on shaft 24. Shaft 24 is journalled to arm 26 of mounting bracket 28 to thereby hold the drum for rotation about the shaft. Bracket 28 is, in turn, mounted to the interior of the enclosure (not shown) by fasteners 29, which may be a bolt or like fastener.

The outer cylindrical surface of drum 22 has affixed thereto and supports a pair of electrically conductive segments 30 and 32 which circumferentially encircle the drum. As can be seen, each conductive segment 30 and 32 is positioned adjacent one of the opposed ends 23 and 25 of the drum.

Also affixed to the drum surface and arranged between the end — encircling conductive segments 30 and 32 — are a number of shorter electrically conductive output segments 34. Output segments 34 are identically shaped, extend in a circumferential (relative to drum 22) direction and are arranged in two electrically interconnected groups A and B — the segments of each group being positioned in circumferentially, staggered relation. Interconnective strip 36 electrically connects segment group A to the encircling segment 30 while segment group B is electrically connected to segment 32 by strip 37.

Segments 34 are arranged in a manner which, for purposes of this discussion, can be thought of as forming circumferential tracks. This is more particularly illustrated in FIG. 4 which is a plan view of the outer surface of drum 22. Segments 34 are shown arranged so that one segment from group A and one segment from group B are positioned in each of four juxtaposed tracks 40–46 in circumferential, adjacent alignment. Each track, and therefore one segment from each group A or B, corresponds to one of speakers A1-A4.

Situated proximate drum 22 and positioned to tangentially engage the drum surface are contact fingers 50, each contact finger corresponding to one of the conductive segments 30 and 32 and one of the tracks 40–46. Contact fingers 50 are attached by an appropriate fastening means 52 to a dielectric board 54 which, in turn, is fixedly mounted to mounting bracket 28.

Attached to the two outer contact finger fasteners 52 are electrical input leads 60 and 62. Affixed to the remaining four contact finger fasteners are output leads 64. The method of fastening input leads 60 and 62 as well as output leads 64 is such that electrical communication is established between each lead and its respective contact finger 50.

Positioned between conductive segment 32 and end 25 of drum 22 is a circumferential groove 68 adapted to receive endless belt 70. Endless belt 70 interconnects drum 22 with a direct current (DC) motor 72 via motor shaft drive wheel 74 which is affixed to motor shaft 76. Electrical leads 78 and 79 interconnect motor 72 with the positive and negative connections, respectively, of an appropriate direct current source (not shown). Motor 72 is of conventional manufacture and design. A number of such motors are well known in the art and will not be discussed further. It is preferably, however, that the motor be provided with a control 80 that varies the motor speed sufficient to allow the rate of rotation of drum 22 to be varied between 1-40 revolutions per minute (RPM).

It is presently contemplated that conductive segments 30, 32 and 34, 34 will be fabricated from thin sheets of copper or like material of low resistivity. Drum 22 is fabricated from a dielectric material such as a plastic or the like. Alternatively, if drum 22 is fabricated from a conductive material, the surface of the drum should be coated with a dielectric material to electrically isolate the conductive segments into the two groups — A and B.

Contact fingers 50 are formed from a spring-steel material having good electrical conductive qualities and resiliency. To date, 0.010 inch diameter spring-steel wire has been found well suited for this application. Alternatively, of course, flat spring-like metallic finger contacts could be used. It has been found that the engagement between copper and steel, as used herein, distributes an audio signal to speakers A1-A4 that is substantially and effectively noiseless than would otherwise be the case with other conductor combinations.

The finger contacts 50 are placed to engage the respective segments approximately in the middle of the tracks. Further, finger contacts 50 are situated to engage the drum so that a bending moment is imparted to each finger contact. This bending moment, in turn, tensions each respective finger contact against the drum and improves the electrical conductivity therebetween.

If desired, a non-conductive or dielectric board or plate (not shown) may be placed in overlying relation with member 54 to sandwich the fastened ends of the finger contacts 50 therebetween. Such an overlying plate aids in holding each finger contact properly against the drum and helps any stress that may be placed upon the finger contacts at their fastening points 52.

In use, distributor 10 is electrically connected to receiver 12 by the left and right channel leads L and R, respectively. When so connected, the right channel lead will be electrically connected to finger contact lead 60. Similarly, the left channel lead of receiver 12 will be electrically connected to finger contact lead 62. Speaker leads 1-4 are attached to distributor 10 so that electrical communication is established between each respective speaker and finger contact leads 64 and, in turn, to finger contacts 50.

Figure 4:
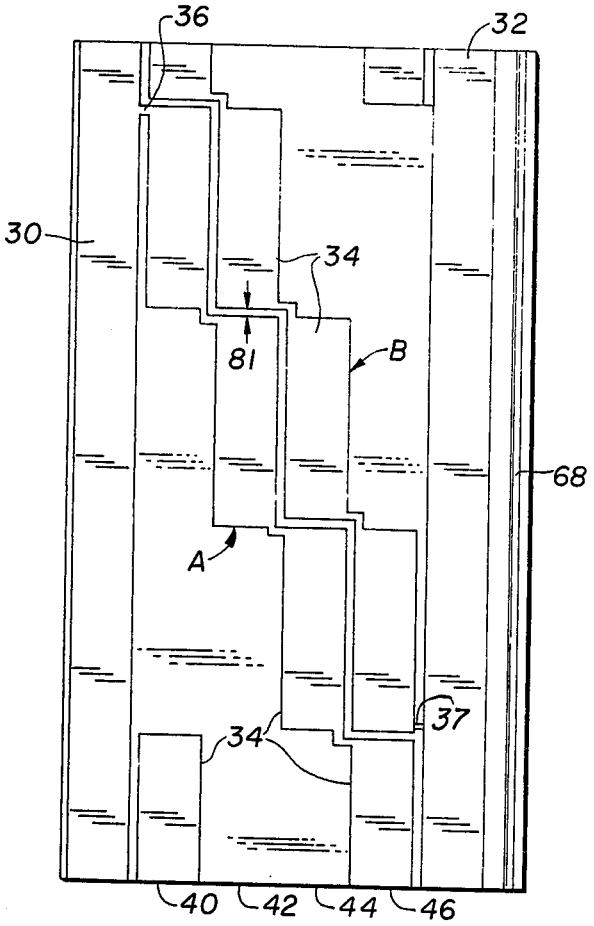
FIG. 4 is a plan view of the surface of the drum shown in FIG. 3.

It should be evident, with reference to FIGS. 3 and 4, that the above-described connection of distributor 10 to receiver 12 establishes an electrical communication between right channel lead R and the interconnected conductive segments 30 and 34 (the latter being group B output segments). Similarly, left channel lead L and output segments 34 of group A are in electrical communication. Thus, audio signal (1) will be present at group A segments while audio signal (*r*) will be present at group B segments during proper attachment and operation of distributor 10.

In operation, motor 72 rotates drum 22 about its longitudinal axis. As drum 22 rotates, the conductive output segments 34 are sequentially brought into and out of contact with contact fingers 50. As each output segment is moved into contact with its corresponding finger contact, the audio signal (1) or (*r*) is communicated and applied to the one of speakers A1-A4 associated therewith.

It is advantageous at this point to note the particular staggered arrangement of group A (or B) segments 34 is such that the audio signal impressed thereon is communicated to only one of the speakers A1-A4 at any one time. In this regard, spacing 81 (shown in exaggerated form in FIG. 4) separates each circumferentially adjacent output segment 34 of each segment group. As drum 22 rotates to move the segments into and out of contact with their respective finger contact 50, the audio signal (1) or (*r*) is applied to only one speaker at any particular moment in time. There will, of course, be a short period of time during which no speaker has an audio signal applied thereto and which is viewed as an open circuit by the output stages of receiver 12. However, the periods are minimized by reducing spacing 80 between segments 34 and, in any event, are so short in time that they will not damage the receiver.

As clockwise rotation of drum 22 continues, audio signal (*r*) will be sequentially applied to speakers A1-A4 in rotating fashion about the perimeter of the listening area. In similar manner, audio signal (1) is also applied to each one of the speakers A1-A4 which immediately preceding in time has been activated by audio signal (*r*).

Figure 5:
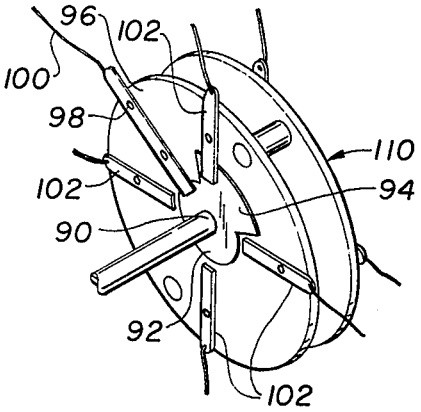
FIG. 5 illustrates another embodiment utilizing a conductive disk that is rotated to establish electrical communication between a signal source and one of a number of speakers.

Illustrated in FIG. 5 is an alternate embodiment of phasing apparatus for sound distribution use. As shown, a shaft 90 has transversely mounted thereon a conductive metal disk 92 having a short, arcuate, radial extending appendage 94. The disk 92 is supported by dielectric wafer 96 to which the shaft 90 is journalled. Mounted on wafer 96 is an input contact finger 98 with an electrical lead 100 extending therefrom which would be electrically connected to one of the output channels of receiver 12. Also mounted on wafer 96 are output contact fingers 102, each contact finger corresponding to one of the speakers A1-A4. Spacing of the output fingers 102 relative to one another, as well as circumferential length or arc of appendage 94, is such that as disk 92 is rotated, the appendage 94 will be brought into contact with only one output finger 102 at a time. The wafer-disk arrangement described effectively communicates a first audio signal applied to input finger 98 to output fingers 102 and any speakers electrically attached thereto in sequential, serial fashion. To apply a second audio signal to the same speakers a second wafer-disk arrangement 110 is added with attention being given to synchronizing the disk-output fingers (not shown) engagement with that of disk 92 and output fingers 102; that is, the audio signal distribution effected by two or more wafer-disk assemblies preferably applies the signals distributed to adjacent speakers in the sequential fashion described above in connection with the distributor 10.

As will now be apparent, an audio signal distributor fabricated in accordance with the teachings of the present invention is relatively inexpensive to manufacture, simple to assemble and use, sufficiently small in size to conveniently be located in any sound system, and has been found to be highly effective in giving the sensation of improved accoustic quality of the sound reproduced.

While the above provides a full and complete disclosure of the preferred embodiments of the invention, various modifications, alternate constructions and equivalents may be employed without departing from the true spirit and scope of the invention. For example, drum 22 could be a circular disk-like structure with segments 34 arranged on one planar surface of the disk in circumferential fashion. Such an arrangement would, of course, take into consideration the circumference of each track relative to its radial distance from the center of the disk. Moreover, a larger number of speakers may be used and, if so, drum 22 (or the number of wafer-disk assemblies of FIG. 5) can be extended accordingly to accommodate additional conductive segments.

Therefore, the above description and illustrations should not be construed as limiting the scope of the invention, which is defined by the appended claims.

What is claimed is:

1. A device for sequentially distributing an audio electrical signal to at least a pair of a plurality of sound reproducing elements, comprising:

first circuit means having the audio electrical signal applied thereto;

a number of second circuit means, each second circuit means corresponding to and in electrical communication with one of the plurality of sound reproducing elements, said first and second circuit means being mounted in spaced relation relative to one another;

a pair of substantially non-resistive, electrical conductive elements mounted to a support member and in electrical communication with the first circuit means, each one of the conductive elements defining a first segment and a plurality of second segments, there being at least one of the second segments for each one of the second circuit means, said support member being situated proximate the first and the second circuit means; and means for cyclically moving the support member to place the conductive elements in electrical communication with the first circuit means and each one of the second circuit means, the plurality of second segments being arranged relative to the second circuit means to establish electrical communication between the first circuit means and at least a pair of the second circuit means at any one moment in time so that the audio electrical signal will be distributed to the pair of the sound reproducing elements in sequential, serial fashion.

2. The device of claim 1, wherein the support member includes a cylinder mounted for rotation about its longitudinal axis, the conductive element being affixed to the outer arcuate surface of the cylinder.

3. The device of claim 2, wherein each of the number of the second circuit means includes a wire-like contact element mounted to tangentially engage the corresponding one of the second segments when the cylinder is rotated.

4. The device of claim 2, wherein the outer surface of the cylinder is fabricated from a dielectric material.

5. The device of claim 1, wherein the support member is defined by a cylindrical drum mounted for rotation about a longitudinal axis of the drum, the drum having an outer dielectric surface with the conductive elements mounted thereon.

6. The device of claim 5, wherein the plurality of second segments of each one of the conductive elements are arranged in longitudinally juxtaposed, circumferentially staggered position.

7. A signal distributor for receiving at least a pair of audio electrical signals and for communicating the signals to an adjacent pair of a plurality of sound reproducing elements situated about and defining a listening area, comprising:

a cylindrical drum mounted for rotation about a longitudinal axis thereof and having an outer dielectric surface;

a first and a second plurality of conductive segments affixed to the outer dielectric surface of the drum, each plurality of conductive segments corresponding to one of the first and the second audio signals, each segment of each plurality of conductive segments corresponding to one of the plurality of sound reproducing elements;

means coupled to the drum for communicating the first audio signal to the first plurality of conductive segments and for communicating the second audio signal to the second plurality of conductive segments;

a number of conductive contact elements mounted to tangentially engage the outer surface of the drum and the conductive segments, each contact element corresponding and electrically communicated to one of the plurality of sound reproducing elements the conductive segments, the communicating means and the contact elements being fabricated from a substantially non-resistive metal;

a motor coupled to the drum for rotating same, the motor having means for varying the rate of rotation of the drum from about one revolution per minute to at least about 40 revolutions per minute;

wherein the drum is rotated by the motor to cyclically bring the conductive segments into electrical communication with corresponding one of the contact elements to sequentially apply the first and the second audio signal to adjacent pairs of the plurality of the sound produced by the sound reproducing elements about the listening area.

* * * * *